US006976909B1

(12) United States Patent
Hoover

(10) Patent No.: US 6,976,909 B1
(45) Date of Patent: Dec. 20, 2005

(54) EXTENDED SANDING SUPPORT

(76) Inventor: Bruce G. Hoover, 17252 Big Rd., Bloxom, VA (US) 23308

( * ) Notice: Subject to any disclaimer, the term of this patent is extended or adjusted under 35 U.S.C. 154(b) by 151 days.

(21) Appl. No.: 10/449,257

(22) Filed: May 30, 2003

(51) Int. Cl.[7] ..... B24B 23/00
(52) U.S. Cl. ..... 451/354; 451/358; 451/359
(58) Field of Search ..... 451/344, 354, 451/358, 359, 559; 408/86, 204

(56) References Cited

U.S. PATENT DOCUMENTS

| | | | | | |
|---|---|---|---|---|---|
| 2,547,922 | A | * | 4/1951 | Bechtold | 30/376 |
| 2,625,062 | A | * | 1/1953 | Heil | 408/79 |
| 3,807,242 | A | * | 4/1974 | Stone | 74/56 |
| 4,317,282 | A | * | 3/1982 | Pace | 30/122 |
| 4,924,578 | A | * | 5/1990 | Chagnon et al. | 30/500 |
| 4,972,589 | A | * | 11/1990 | Povleski | 30/500 |
| 5,096,341 | A | * | 3/1992 | Despres | 408/68 |

* cited by examiner

*Primary Examiner*—Timothy V. Eley
(74) *Attorney, Agent, or Firm*—Miller Patent Services; Jerry A. Miller

(57) ABSTRACT

An extended sanding support tool, consistent with certain embodiments of the present invention has an elongated metal housing having first and second ends. A first bearing is coupled to the housing adjacent the first end and a second bearing is within the housing closer to the second end than the first end. A mandrel has a drill attachment end and a working end and passes through the first and possibly second bearings with the working end extending beyond the first end of the housing. In one embodiment, a cavity between the second end of the housing and the second bearing is provided for engaging a stationary portion such as a collar of an outer surface of a rotary tool housing an outer surface of a chuck of a rotary tool. In another embodiment a cone shaped structure receives the outer surface of the chuck. A cutting or sanding device is attached to the working end of the mandrel.

23 Claims, 2 Drawing Sheets

EXTENDED SANDING SUPPORT

FIELD OF THE INVENTION

This invention relates generally to the field of sanding. More particularly, this invention relates to a device for providing extended support when power sanding using a drill or similar device.

BACKGROUND OF THE INVENTION

Sanding is generally considered one of the more tedious jobs associated with woodworking (and working similar materials). Often, power tools of various types are employed to ease the burden of sanding. One tool that is commonly employed is a power drill outfitted with a sanding disk that rotates when the drill motor is engaged.

Using a drill as a sanding device can have drawbacks when attempting to sand the inside of a narrow and deep workpiece. A good example is that of a deep wooden bowl or other vessel turned on a woodturning lathe. Often, the drill itself is too large to be able to comfortably fit inside the vessel and permit sanding of the deeper areas of the vessel. Moreover, a drill can be difficult to control when held by a single hand in attempts to sand inside such a vessel. While long mandrels are available that can be used to extend the reach of a sanding disk, the longer the mandrel, the more difficult they are to control.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION OF THE INVENTION

Figure 1:
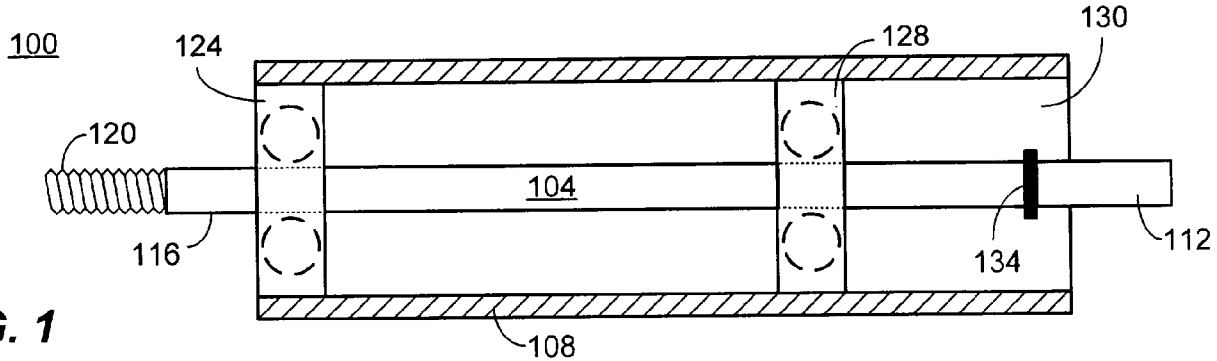
FIG. 1 is a partial cutaway view of an extended sanding support tool consistent with certain embodiments of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings. The present invention relates generally to an extended sanding support device. Objects, advantages and features of the invention will become apparent to those skilled in the art upon consideration of the following detailed description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Turning now to FIG. 1, one embodiment of an extended sanding support device consistent with the present invention is depicted as support device 100. In this embodiment, a steel shaft forms a mandrel 104 (e.g., made of ¼" to ⅝" stainless steel rod stock, with ⅜" generally providing good support) passes through an elongated hollow cylindrical housing 108 (depicted in cross-section). The mandrel 104 has an end 112 that is extendable to beyond the end of the housing 108 and is adapted to accept a drill chuck such as a Jacob's Chuck™. The drill end 112 may be cylindrical as shown or may be machined to a hexagonal shape to permit a drill chuck to securely hold the drill end 112. The housing should be rigid and may be made of a metal such as aluminum or other suitable material. One skilled in the art will recognize after consideration of the present teaching that other shapes of housing 108 may also be suitable.

The other end 116 (the working end or sanding end 116) of mandrel 104 of the current embodiment is threaded at 120 to receive a drill chuck such as a Jacob's Chuck™ or a suitably threaded cutting device. While a male thread is shown, a bore with a female thread could also be provided to permit attachment of a male threaded cutting device by engagement of screw threads. In other embodiments, other mechanisms can be used to receive a sanding disk or other sanding device, or the sanding device may be made integral to mandrel 104 without departing from the present invention.

Mandrel 104 of this embodiment may be circular in cross section at least at two locations where the mandrel 104 passes through a pair of bearings or bushings 124 and 128. These bearings can be any suitable bearing devices including, but not limited to nylon, Teflon™, graphite, brass or other suitable material sleeve bearings or bushings, ball bearings, roller bearings or any other conventional bearing or bushing device or material. Bearing 124 is situated at or near an end of the housing 108. Bearing 128 is situated further into the hollow housing, for example, approximately 1–3 inches from the other end of housing 108. This forms a cavity 130 at the end of the extended sanding support tool's housing. A stop 134, such as an O-ring, C-clip, E-clip or machined ridge in shaft may be used at the outside of one or both of the bearings to prevent the shaft 104 from slipping through and becoming disengaged from the bearings 124 and 128.

Figure 2:
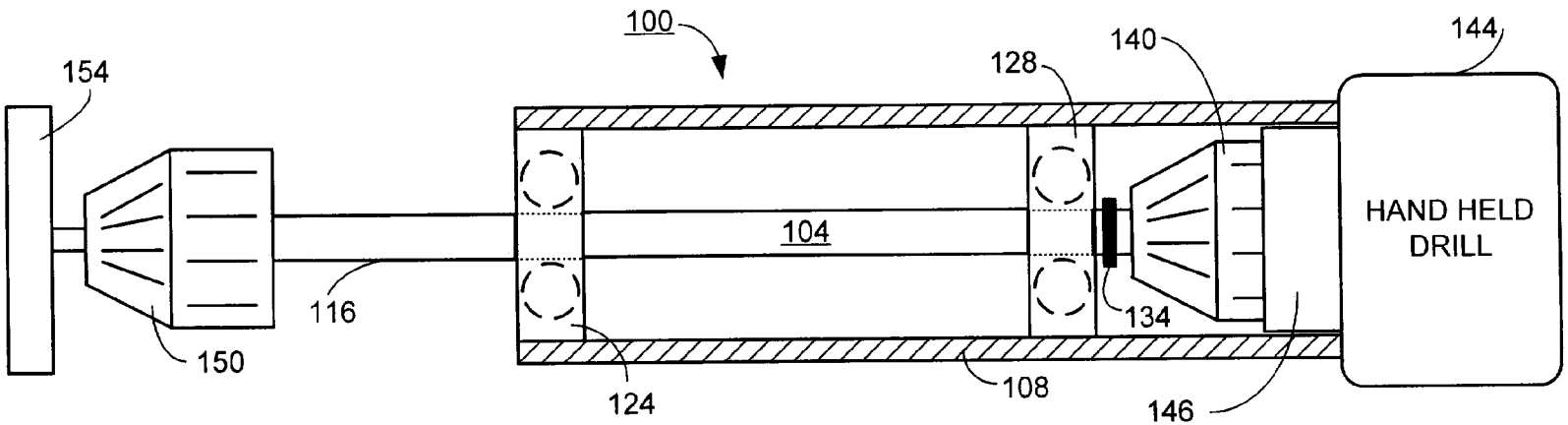
FIG. 2 is a partial cutaway view of the embodiment of an extended sanding support tool shown in FIG. 1 with a drill, chuck and sanding disk attached in a manner consistent with certain embodiments of the present invention.

With reference to FIG. 2, the operation of the extended sanding support tool 100 can be understood. In FIG. 2, the drill end 112 of mandrel 104 is grasped by the chuck 140 of a hand held power drill 144. The other end (the sanding end) 116 of mandrel 104 is threaded onto a drill chuck 150 which in turn grips a sanding device 154 such as a sanding pad, flap sander, sanding disk, or the like. In this manner, the mandrel 104 serves to extend the reach of the drill chuck 140 out to drill chuck 150 so that the body of the hand held drill 144 is held back out of the way permitting the sanding disk 154 to be used to sand a workpiece (and in particular, a workpiece that will not accept the size of the drill). The drill chuck 140 is inserted within cavity 130 during this operation.

Cavity 130 is sized to accept a standard drill chuck (e.g., approximately 1⅝" diameter has been found suitable for use with a Milwaukee model 0375-1 drill (Milwaukee Electric Tool Corporation, Brookfield, Wis.) or Sioux drill model 8000ES (Sioux Tools, Murphy, N.C.). In these commercially available brands of drill, a stationary (with respect to the drill's body—i.e., non-rotating) collar 146 is rigidly attached to the drill's housing and covers the rearmost portion of chuck 140. In these particular commercially available brands of drill, the chuck is a conventional chuck that uses a key to tighten and loosen the chuck. When the chuck is outside the housing 108, the mandrel and chuck 140 are easily accessed to tighten or loosen the mandrel 104 from the chuck 140. When using the extended sanding tool 100, the housing 108 is pulled back into engagement with the body 144 of the drill so that the cavity 13*b* pulled into engagement with the collar 146. In this manner, the housing 108 and the body of the drill 144 are held in rigid alignment with one another so that the user can hold the housing 108 with one hand and the drill 144 with the other during the sanding or cutting operation in order to provide two points of support during the operation. Any gap between the wall of cavity 130 and chuck 140 can be minimized by use of electrical tape or a suitable bushing or other shim mechanism to account for production variations between the outer dimension of the collar 146 and the inner dimension of the cavity 130 and further steady the tool 100.

In use, the drill 144 is held in one hand and energized while holding the housing 108 with the other hand while the collar 146 is engaged in cavity 130 to steady the device 100. Mandrel 104 spins freely in bearings 124 and 128 and chuck 140 spins within cavity 130. This permits the user to provide support to the mandrel 104 along a substantial length of the mandrel 104 with bearing 124 providing support near the workpiece. This inhibits flexing of the mandrel and loss of control during the sanding process. In other embodiments, more bearings can be provided to even further inhibit the flexing of the mandrel 104 or bearing 128 may be omitted, although this provides less support.

Thus, in certain embodiments consistent with the present invention, an extended sanding support tool has an elongated metal housing having first and second ends. A first bearing is coupled to the housing adjacent the first end. A second bearing may be disposed within the housing closer to the second end than the first end. A mandrel having a drill attachment end and a working end passes through the first and second bearings with the working end extending beyond the first end of the housing. A cavity between the second end of the housing and the second bearing forms one embodiment of a structure for engaging an outer surface of a chuck of a rotary tool. A sanding device or other cutting device is attached to the working end of the mandrel.

Figure 3:
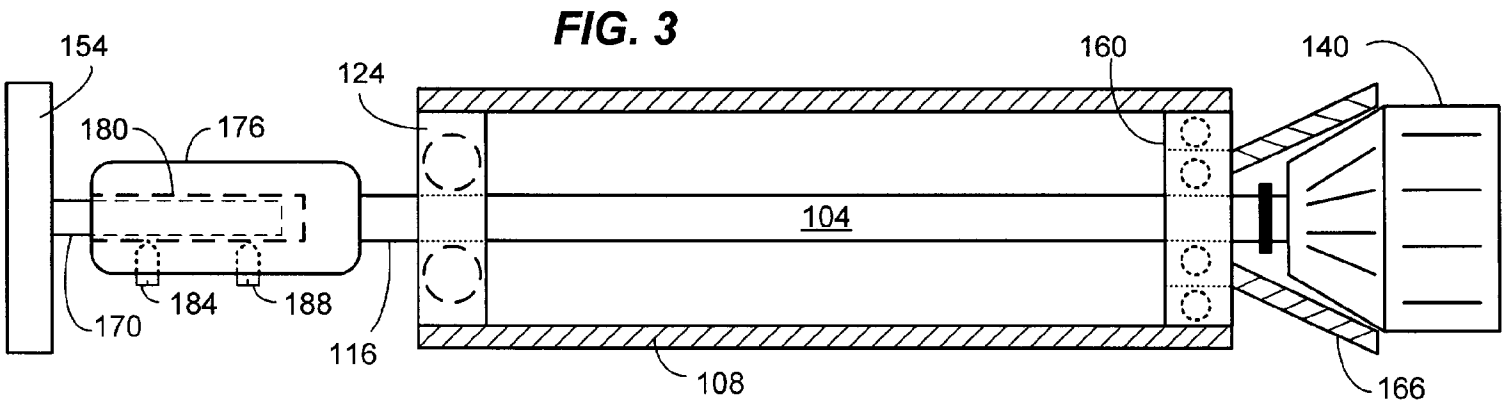
FIG. 3 is a partial cutaway view of a second embodiment of an extended sanding support tool consistent with certain embodiments of the present invention.

With reference to FIG. 3, another embodiment consistent with the present invention is depicted in which mandrel 104, housing 108 and bearing 124 operate as previously described. In this embodiment, a second bearing 160 is a dual bearing situated near the drill end 112 of the mandrel 104. Bearing 160 permits the mandrel 104 to spin freely and further permits a conical (or other suitably shaped) chuck engaging or receiving member 166 to rotate freely of the mandrel 104 and the housing 108. In this embodiment, the drill may be steadied by pushing the drill's chuck 140 into engagement with the chuck receiving member 166 while energizing the drill. The housing is similarly held with a second hand to steady and control the sanding operation.

At the working end 116 of the mandrel 104, the present embodiment illustrates another technique for securing sanding disk 154's shaft 170 to the mandrel 104. In this embodiment, the mandrel 104 is fitted with an end section 176 with an enlarged diameter. This end section 176 has an aperture 180 drilled or otherwise fabricated along it's length which is centered about the axis of the mandrel 104. The aperture 180 is sized appropriately to receive the shaft 170 of the sanding disk 154. The shaft 170 is then secured to the mandrel 104 by use of one or more set screws (two shown) such as 184 and 188. In other embodiments, the aperture could be threaded with a female thread to receive the shaft of a cutting device. Still other embodiments could use a taper such as a Morse taper or a locking mechanism (e.g., a spring loaded aperture with a slot that permits a pin to engage the slot in a locking engagement).

Figure 4:
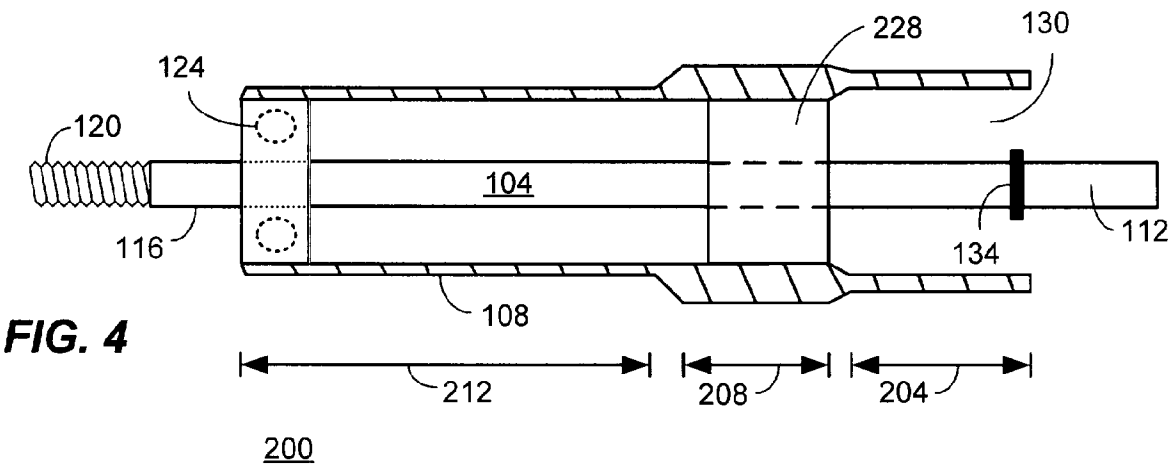
FIG. 4 is a partial cutaway view of a second embodiment of an extended sanding support tool consistent with certain embodiments of the present invention.

Another embodiment consistent with the present invention is depicted in FIG. 4, in which certain modifications are made to the device 100 of FIG. 1 to produce device 200. In this embodiment 200, the housing 108 is machined from a rod or tube of aluminum or other suitable rigid material and remains approximately cylindrical in shape with the cylinder's wall thickness varied as will be described. The inner diameter 130 is machined to a diameter that is suitable for mating to a drill collar 146 as previously described in the region shown as 204. In region 204 a suitable thickness of housing material is retained to provide structural integrity, but the outer diameter is machined down to permit the trigger of the above mentioned commercially available drills to move freely without interference from the housing 108. A transition in inner and outer diameter may then be made to region 208. In this region the inner diameter is set to mate with an appropriate bearing or bushing 228. The outer diameter can be made larger in region 208 to provide a rough depth gauge and to provide a comfortable handle for larger hands. In this embodiment, bearing 228 is shown as a solid bushing-type bearing, but other bearings could also be used without departing from the invention. The inner diameter can be retained after a transition to region 212 or can be modified. The outer diameter may be machined to a smaller dimension (e.g., approximately 1⅝ *inches*) to facilitate entry of the tool and sanding disk into a smaller opening and to provide a comfortable area to hold when the full extension is not *needed*.

Figure 5:
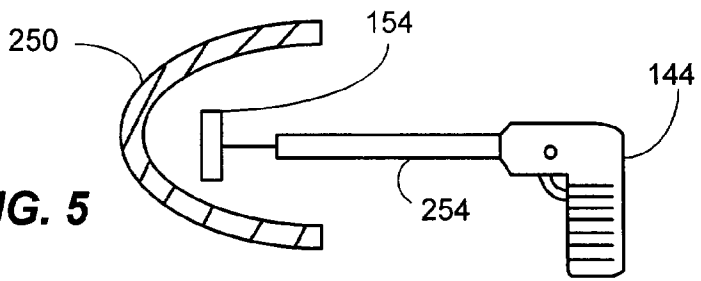
FIG. 5 illustrates use of an extended sanding support tool used in sanding a hollow vessel (shown in cross-section) in a manner consistent with certain embodiments of the present invention.

With reference to FIG. 5, an extended sanding support tool is depicted in use in sanding the interior of a deep turned wooden vessel 250 (shown in cross-section). By use of the extended sanding support tool of suitable length, a sanding disk 154 can be inserted deep within the cavity of the hollow vessel 250 while being driven by drill 144. By gripping the housing of the extended sanding support tool in the region shown as 254, two hands can be used to steady and control the sanding operation while keeping the hands safely away from the edge of the hollow vessel 250. This may provide an additional measure of safety if the vessel 250 is attached to a lathe and spinning during the sanding operation.

Thus, in accordance with certain embodiments consistent with the present invention a extended sanding support tool has an elongated housing having first and second ends. A first bearing is coupled to the housing adjacent the first end. A second bearing may be positioned within the housing closer to the second end than the first end. A mandrel having a drill attachment end and a working end passes through the first and second bearings with the working end extending beyond the first end of the housing. A sanding or other cutting device can be attached to the working end of the mandrel.

Many variations of the present embodiments will become apparent to those skilled in the art upon consideration of the present teachings. For example, any suitable support for alignment of the drill chuck at the drill end 112 of the mandrel can be used without departing from the present invention. The use of cavity 130 or support member 166 should not be considered exhaustive of such structures. Any suitable type of bearings can be used without limitation to the above examples. The housing, since it serves also as a handle, may be outfitted with a handle of any sort, or may be coated with rubber or other material, or textured to provide a good gripping surface. The housing may be made of any suitable rigid material such as aluminum or other metals and may be made any desired length. Tools with lengths of approximately 12 inches and 24 inches have been found suitable for many applications. Models have been prototyped at approximately 36 inches in length with good success, and it is contemplated that even greater length can be handled. In longer models, bearings spaced at approximately every 16 inches has been found suitable to avoid undesirable whipping of the mandrel. The conical structure 166 and aperture 130 are only to exemplary structures of rotary tool engaging or receiving structures that can be used. The sanding can be accomplished using a disk, pad, flap sander, any other abrasive or cutting device (generically cutting device) that can be driven by a drill or similar rotary tool. In this context, wire brushes cutting wheels, blades or any other devices that can be driven by the drill should be considered equivalent for purposes of this document since, although designed to facilitate deep sanding, certain embodiments consistent with the present invention can equivalently be used for drilling, boring, cutting, scribing, texturing, grinding, rasping, buffing, polishing, finishing or other operations without departing from the spirit and teachings embraced herein.

While certain embodiments are shown to be configured for use with certain commercially available drill models, it will be clear to those skilled in the art that this is a convenience for providing a suitable mechanism for engagement of the housing body 108 with a structure (collar 146) of these particular drills. Any other suitable mechanism which can be used to permit the user to steady the drill end of the housing 108 to a drill body can equivalently be used. Such other mechanisms may involve adapting the drill body to receipt of such a housing by use of brackets, pins, tabs, apertures, saddles, collars, shapes conforming to the housing or other structures. In other embodiments, the housing itself may similarly have structures for engaging the drill housing including, but not limited to, brackets, pins, tabs, apertures, collars, saddles, shapes conforming to a part of the drill body or other structures. In one embodiment, for example, the opening 130 can simply be sized appropriately to permit a chuck to spin freely therein while the housing 108 is held into engagement manually with the drill body. Other variations of structures for engaging the housing 108 with the drill body will occur to those skilled in the art upon consideration of the present teachings and should be considered equivalent.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the spirit and broad scope of the appended claims.

What is claimed is:

1. An extended sanding support tool, comprising:

an elongated housing having first and second ends;

a first bearing coupled to the housing adjacent the first end;

a mandrel having length and having a drill attachment end and a working end passing through the first bearing with the working end extending beyond the first end of the housing;

wherein, the housing is slideable along a portion of the length of the mandrel while the mandrel is coupled to a rotary tool, so that the housing selectively engages a portion of the rotary tool when the housing is slid along the mandrel toward the rotary tool in order to stabilize the housing, so that the user can selectively engage the housing with the rotary tool by sliding the housing toward the rotary tool and holding the housing in place; and means for attaching a cutting device or sanding device to the working end of the mandrel.

2. The extended sanding support tool according to claim 1, wherein the housing has a cylindrical cavity adjacent the second end of the housing, and wherein the cylindrical cavity receives and engages a cylindrical collar adjacent a chuck of the rotary tool when the housing is slid toward the rotary tool, and wherein the cylindrical collar is stationary with respect to rotation of the rotary tool's chuck, so that the housing can be stabilized by holding the cylindrical cavity in engagement with the stationary cylindrical collar.

3. The extended sanding support tool according to claim 1, wherein when the housing is slid along the mandrel away from the rotary tool, a chuck of the rotary tool is revealed.

4. The extended sanding support tool according to claim 3, further comprising means for stopping the mandrel from sliding past the first bearing when the housing is slid away from the rotary tool to reveal the rotary tool's chuck.

5. The extended sanding support tool according to claim 1, further comprising chuck receiving means for receiving an outer surface of a chuck of a rotary tool.

6. The extended sanding support tool according to claim 5, wherein the chuck receiving means comprises a conical chuck receiving member that mates with a conical outer surface of the chuck of the rotary tool.

7. The extended sanding support tool according to claim 6, wherein the second bearing comprises a dual bearing situated adjacent the second end, and wherein the conical chuck receiving member is mounted to the bearing such that the mandrel, the conical chuck receiving member and the housing can rotate independently of one another.

8. The extended sanding support tool according to claim 1, further comprising a second bearing within the housing closer to the second end than the first end with the mandrel passing therethrough.

9. The extended sanding support tool according to claim 1, wherein the means for attaching a cutting device to the working end of the mandrel comprises at least one of a chuck, a taper, a locking engagement mechanism, a screw thread, and a bore with set screws.

10. The extended sanding support tool according to claim 1, wherein the housing is at least 12 inches in length, and wherein the second bearing is approximately 1 to 3 inches from the second end.

11. The extended sanding support tool according to claim 1, wherein the mandrel is approximately ¼ to ⅝ inch in diameter.

12. An extended sanding support tool, comprising:

an approximately cylindrical elongated housing having first and second ends at openings of the cylinder;

a first bearing coupled to the housing adjacent the first end;

a mandrel having length and having a drill attachment end and a working end passing through the first bearing with the working end extending beyond the first end of the housing;

an approximately cylindrical cavity between the second end of the housing and the second bearing for receiving a stationary portion of an outer surface of a rotary tool housing, the stationary portion of the outer surface of the rotary tool housing being adjacent a chuck of said rotary tool, and being stationary with respect to rotation of the chuck, and having a substantially circular cross-section;

wherein, the housing is slideable along a portion of the length of the mandrel so that the approximately cylindrical cavity receives the stationary portion of the outer surface of the rotary tool housing when the housing is slid along the mandrel toward the rotary tool, and wherein when the housing is slid along the mandrel away from the rotary tool the chuck of the rotary tool is revealed; and means for attaching a cutting device or a sanding device to the working end of the mandrel.

13. The extended sanding support tool according to claim 12, further comprising a second bearing within the housing closer to the second end than the first end with the mandrel passing therethrough.

14. The extended sanding support tool according to claim 12, wherein the means for attaching a cutting device to the working end of the mandrel comprises at least one of a chuck, a taper, a locking engagement mechanism, a screw thread, and a bore with set screws.

15. The extended sanding support tool according to claim 12, wherein the housing is at least 12 inches in length, and wherein the second bearing is approximately 1 to 3 inches from the second end.

16. The extended sanding support tool according to claim 12, wherein the mandrel is approximately ¼ to ⅝ inch in diameter.

17. An extended sanding support tool, comprising:

an elongated cylindrical metal housing having first and second ends, the cylindrical metal housing defining an outermost boundary of the support tool between the first and second ends;

a first bearing coupled to the housing adjacent the first end;

a second bearing within the housing closer to the second end than the first end;

a mandrel having length and having a drill attachment end and a working end passing through the first and second bearings with the working end extending beyond the first end of the housing;

a cylindrical cavity between the second end of the housing and the second bearing for receiving and contacting a cylindrical stationary portion of an outer surface of a rotary tool housing, the cylindrical stationary portion being stationary with respect to a rotating portion of the rotary tool; and means for attaching a cutting device or a sanding device to the working end of the mandrel.

18. The extended sanding support tool according to claim 17, wherein the means for attaching a cutting device to the working end of the mandrel comprises at least one of a chuck, a taper, a locking engagement mechanism, a screw thread, and a bore with set screws.

19. The extended sanding support tool according to claim 17, wherein the housing is at least 12 inches in length, and wherein the second bearing is approximately 1 to 3 inches from the second end; and wherein the mandrel is approximately ¼ to ⅝ inch in diameter.

20. The extended sanding support tool according to claim 17, wherein the cavity between the second end of the housing and the second bearing is adapted to receive a stationary collar connected to the rotary tool housing.

21. The extended sanding support tool according to claim 17, wherein, the housing is slideable along a portion of the length of the mandrel so that the cylindrical cavity receives the stationary portion of the outer surface of the rotary tool housing when the housing is slid along the mandrel toward the rotary tool.

22. The extended sanding support tool according to claim 21, wherein when the housing is slid along the mandrel away from the rotary tool, a chuck of the rotary tool is revealed.

23. The extended sanding support tool according to claim 22, further comprising means for stopping the mandrel from sliding past the bearing when the housing is slid away from the rotary tool to reveal the chuck.

* * * * *

UNITED STATES PATENT AND TRADEMARK OFFICE

CERTIFICATE OF CORRECTION

PATENT NO. : 6,976,909 B1
DATED : December 20, 2005
INVENTOR(S) : Bruce G. Hoover It is certified that error appears in the above-identified patent and that said Letters Patent is hereby corrected as shown below:

Column 3,
Line 22, delete “13b,” and insert -- 130 --.

Column 4,
Line 48, “needed” should not be in italics.

Column 7,
Line 27, delete “the” and insert -- a --.

Signed and Sealed this

Twenty-first Day of February, 2006

JON W. DUDAS
*Director of the United States Patent and Trademark Office*